US006379121B1

(12) United States Patent
Ota et al.

(10) Patent No.: US 6,379,121 B1
(45) Date of Patent: Apr. 30, 2002

(54) SUCTION VALVE IN VARIABLE DISPLACEMENT COMPRESSOR

(75) Inventors: Masaki Ota; Toshihiro Kawai; Masahiro Kawaguchi; Tomoji Tarutani, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/694,415

(22) Filed: Oct. 23, 2000

(30) Foreign Application Priority Data

Oct. 25, 1999 (JP) ..... 11-302279

(51) Int. Cl.[7] ..... F04B 1/26
(52) U.S. Cl. ..... 417/222.2; 417/269
(58) Field of Search ..... 417/222.2, 269, 417/540, 569, 270

(56) References Cited

U.S. PATENT DOCUMENTS 4,730,987 A * 3/1988 Kawai et al. ..... 417/270
4,867,650 A * 9/1989 Ikeda et al. ..... 417/269
5,266,016 A * 11/1993 Kimura et al. ..... 417/569
5,267,839 A * 12/1993 Tarutani et al. ..... 417/269
5,603,611 A * 2/1997 Ikeda et al. ..... 417/269
5,888,506 A * 3/1999 Kung et al. ..... 417/569
6,045,342 A * 4/2000 Kimura ..... 417/540
6,318,972 B1 * 11/2001 Huang et al. ..... 417/269

* cited by examiner

*Primary Examiner*—Teresa Walberg
*Assistant Examiner*—Leonid Fastovsky
(74) *Attorney, Agent, or Firm*—Morgan & Finnegan, LLP

(57) ABSTRACT

The object of the present invention is to offer a structure of a suction valve enough to prevent a noise or clatter caused by vibrations of a suction valve in a variable displacement compressor having pistons.

The suction valve is a bendable flexible valve composed of flexible portions, and of a closing portion placed adjoining to the flexible portions to form a free end to close a suction port. The lengths of the flexible portions of the suction valve are nearly equal, but the widths of the flexible portions of the suction valve are different each other. And the distance between the suction valve and a receiving portion which regulates maximum opening degree, is determined so that the lower bending flexibility side of the flexible portions contacts the receiving portion from the beginning or as soon as the suction valve starts to open, and that the higher bending flexibility side of the flexible portions approaches the receiving portion with the lower bending flexibility side of the flexible portion contacting the receiving portion, while the suction valve is twisted.

8 Claims, 6 Drawing Sheets

SUCTION VALVE IN VARIABLE DISPLACEMENT COMPRESSOR

BACKGROUND OF THE INVENTION

The present invention relates to a suction valve in a following variable displacement compressor. The compressor has a swash plate accommodated in a crank chamber, where the pressure is controlled so as to rotate the swash plate integrally and inclinably with a drive shaft, and a plurality of pistons, which are accommodated in cylinder bores arranged around the drive shaft and reciprocate in accordance with rotation of the swash plate. The inclination angle of the swash plate is adjusted in response to the pressure in the crank chamber, which is changed by adjusting the amount of gas supplied from a discharge chamber to the crank chamber, and the amount of gas relieved from the crank chamber to the suction chamber. Furthermore, flexible suction valves open and close suction ports, and in suction movements of the pistons, the suction valves are pushed up and draw gas through the suction ports into the cylinder bores.

In a piston type compressor, while the suction valves move from a closed position to close the suction ports to the maximum opening position to open the suction ports, vibrations occur at suction valves and this causes suction pulsations. The suction pulsations cause the evaporator in the outer refrigerant circuit to vibrate and generate noise.

In a variable displacement compressor having pistons, the pistons reciprocate with a stroke in accordance with the inclination angle of the inclinable swash plate, and the discharge capacity decreases when the inclination angle of the swash plate decreases. In a small discharge capacity state, an average amount of gas passing through the suction port is small, and the suction valve can hardly contact a stopper for regulating the maximum opening degree due to its small opening degree. As a result, in the variable displacement compressor the vibrations of the suction valve easily occur.

SUMMARY OF THE INVENTION

The object of the present invention is to offer an effective suction valve enough to prevent noise or clatter caused by vibrations of suction valves in a variable displacement compressor.

To achieve the above object, the inventors propose a following variable displacement compressor. The compressor has a swash plate accommodated in a crank chamber, where the pressure is controlled, so as to rotate the swash plate integrally and inclinably with a drive shaft, and a plurality of pistons, which are accommodated in cylinder bores arranged around the drive shaft and reciprocate in accordance with rotation of the swash plate. The inclination angle of the swash plate is adjusted in response to the pressure of the crank chamber, which is changed by adjusting the amount of gas supplied from a discharge chamber to the crank chamber, and the amount of gas relieved from the crank chamber to the suction chamber. Furthermore, flexible suction valves open and close suction ports, and in suction movements of pistons the suction valves are pushed up and draw gas through the suction ports into the cylinder bores.

Furthermore, in the present invention, a twisting flexibility regulating means to bend and twist the suction valve, and a maximum opening degree regulating means having a receiving portion receiving the suction valve and regulating maximum opening degree of the suction valve in contact with the suction valve comprise the structure of the suction valve. The maximum opening degree regulating means is formed at the associated cylinder bore as follows. A first distance (between the suction valve at the more twisted side in closed position and a confronting point on the receiving portion) is longer than a second distance (between the suction valve at the other side in closed position and a confronting point on the receiving portion).

Therefore, the suction valve bends while twisting and the opposite side to the twisted side contacts the receiving portion first. Then, as the opening degree of the suction valve becomes larger, the suction valve becomes more twisted. And the twisted side of the suction valve approaches the receiving portion.

Furthermore, in the present invention, the maximum opening degree regulating means is a recess for regulating maximum opening degree recessed in the direction of the reciprocating movement of the piston along the circumferential surface of the cylinder bore. And the receiving portion is a bottom of the recess for regulating maximum opening degree, which is the receiving portion of the recess. Moreover, the receiving portion is inclined in the direction of width of the confronting suction valve.

As for the suction valve, the lower bending flexibility side of the suction valve contacts the shallower stopper side of the recess for regulating maximum opening degree first. Then, as the opening degree of the suction valve becomes larger, the suction valve becomes more twisted. And the higher bending flexibility side of the suction valve approaches the deeper stopper side of the recess for regulating maximum degree of opening.

Furthermore, in the present invention the twisting flexibility regulating means comprises two bending flexibility regulating means of which bending flexibilities are different each other and arranged in the direction of width of the suction valve, so that the distance between the higher bending flexibility side of the suction valve and the confronting receiving portion is longer than that between the lower bending flexibility side and the confronting receiving portion.

As for the suction valve, the lower bending flexibility side of the suction valve contacts the receiving portion first. Then, as the opening degree of the suction valve becomes larger, the suction valve becomes more twisted. And the higher bending flexibility side of the suction valve approaches the receiving portion. Thus, in the arrangement that the bending flexibilities are different each other in the direction of width of the suction valve, the suction valve twists easily when the opening degree of the suction valve becomes large.

Furthermore, in the present invention, the suction valve has a pair of flexible portions separated in width and a closing portion closing the suction port placed adjoining to a pair of the flexible portions. The bending flexibility regulating means is a pair of the flexible portions. And each flexible portion urges the suction valve so as to close the suction port. And the bending flexibilities of a pair of the flexible portions are different.

In the above arrangement, the suction valve twists easily when the opening degree of the suction valve becomes large.

Furthermore, in the present invention, while the thickness of a pair of the flexible portions are equal, the bending flexibilities of them are different, since the width of a pair of the flexible portions are different.

The shorter the width of the flexible portion is, the higher the bending flexibility becomes.

Furthermore, in the present invention, the suction valve has a single flexible portion, and the closing portion closing the suction port placed adjoining to the flexible portion. Moreover, the flexible portion urges the suction valve so as to close the suction port. And the flexible portion, which is biased in the direction of width from the central line of the suction valve, is the twisting flexibility regulating means.

Therefore, the twisting flexibility becomes extremely high.

Furthermore, in the present invention, a part of the closing portion substantially constantly contacts the receiving portion of the recess for regulating maximum opening degree.

Therefore, the vibrations of the suction valve are securely prevented.

Furthermore, in the present invention, a plurality of the pistons are arranged around the drive shaft. The pistons reciprocate in the cylinder bore in accordance with the rotation of the drive shaft. The suction ports are formed in a valve plate defining a suction chamber, a discharge chamber and the cylinder bores. The discharge chamber is formed so as to surround the suction chamber. The gas in the suction chamber is sucked through the suction ports into the cylinder bores. The gas in the cylinder bores is discharged through the discharge ports formed in the valve plate into the discharge chamber.

In the arrangement that the discharge chamber surrounds the suction chamber, a cylindrical suction chamber can be formed. In the arrangement that the suction chamber surrounds the discharge chamber, a circular suction chamber is formed. The cylindrical suction chamber is superior to the circular suction chamber to suppress the suction pulsations.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

FIG. 4(*a*) is a cross-sectional view as seen from line III—III in FIG. 4;

FIG. 5(*a*) is a cross-sectional view as seen from line IV—IV in FIG. 5;

FIG. 6(*a*) is a cross-sectional view as seen from line V—V in FIG. 6.

DETAILED DESCRIPTION OF PREFERRED EMBODIMENTS

A first embodiment of the valve in the variable displacement compressor according to the present invention will now be described in FIG. 1 to FIG. 4(*a*).

Figure 1:
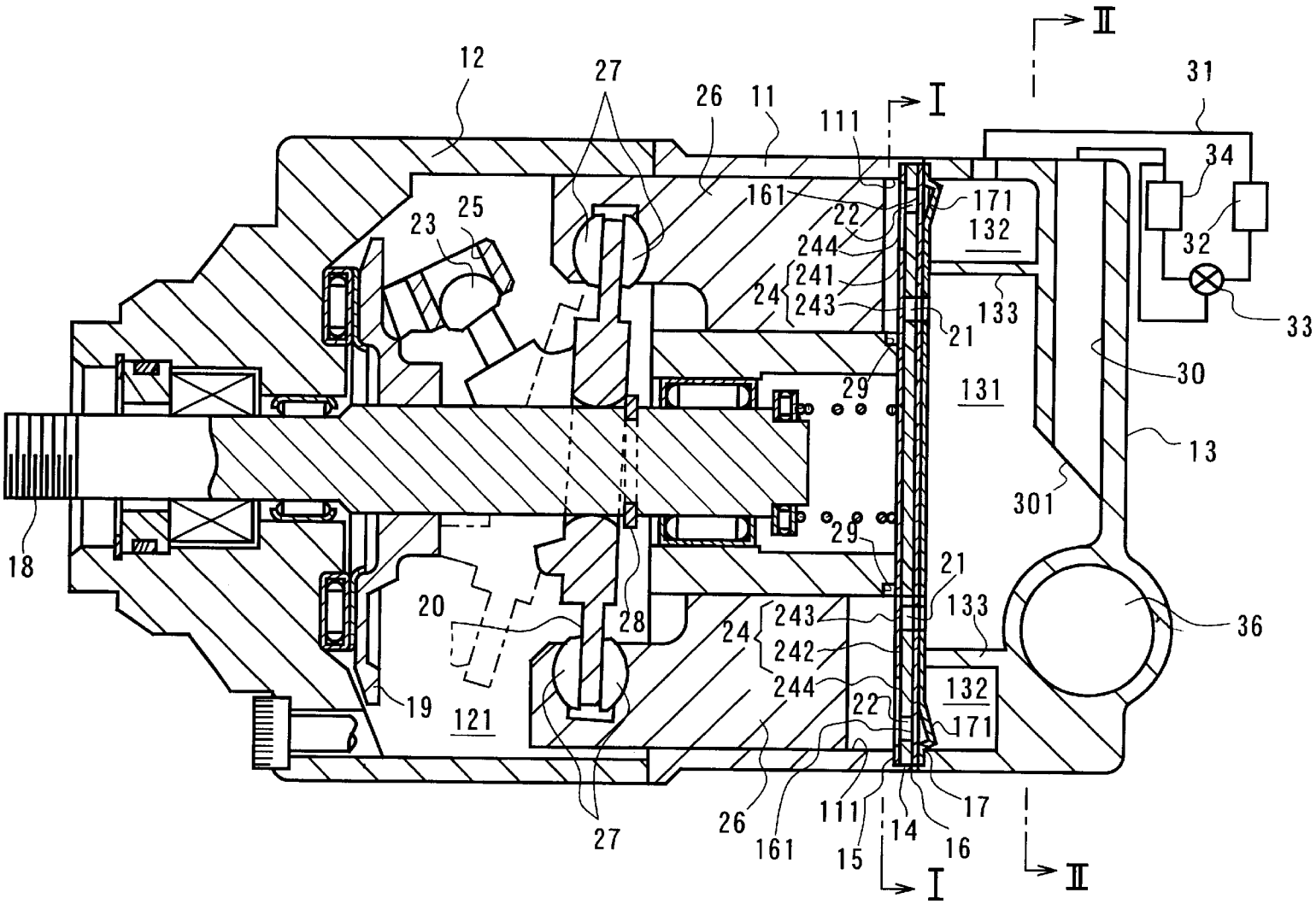
FIG. 1 is a cross-sectional view illustrating a compressor according to a first embodiment of the present invention.

As shown in FIG. 1, a front housing 12 is secured to the front side of a cylinder block 11. A rear housing 13 is secured via a valve plate 14, a suction valve disk 15, a discharge valve disk 16 and a retainer plate 17 to the rear side of the cylinder block 11. A drive shaft 18 is rotatably supported by the front housing 12 and the cylinder block 11. The front housing 12 and the cylinder block 11 define a crank chamber 121 therebetween, where the pressure is controlled. The drive shaft 18 protrudes from the crank chamber 121 and the driving force is transmitted to the drive shaft 18 through a pulley (not illustrated) and a belt (not illustrated) from an external driving source such as a vehicle engine (not illustrated).

A rotor 19 is mounted on the drive shaft 18. A swash plate 20 is supported on the drive shaft 18 slidably in the direction of the axis of the drive shaft 18, and inclinably with respect to the axis of the drive shaft. The swash plate 20 rotates integrally with the drive shaft 18 by the cooperation between a pair of guide pins 23 mounted on the swash plate 20 and a pair of guide holes 25 at the rotor 19. The inclination of the swash plate 20 is guided by the slide guide relation that the surfaces of the guide hole 25 and the guide pin 23 contact each other, and by the support of the drive shaft 18 whose outer surface contacts the surface of a center through hole of the swash plate 20. The guide pin 23 and the guide hole 25 comprise the guide mechanism to incline and slide the swash plate 20.

When the radial center of the swash plate 20 moves to the rotor 19 side, the inclination angle of the swash plate 20 increases. When the radial center of the swash plate 20 moves to the cylinder block 11 side, the inclination angle of the swash plate 20 decreases. The minimum inclination angle of the swash plate 20 is regulated by abutting contact between a circular clip 28 mounted on the drive shaft 18 and the swash plate 20. The maximum inclination angle of the swash plate 20 is regulated by abutting contact between the rotor 19 and the swash plate 20. The solid lines and the two-dot line of the swash plate 20 in FIG. 1 respectively show the positions of the minimum inclination angle and the maximum inclination angle of the swash plate 20.

Figure 2:
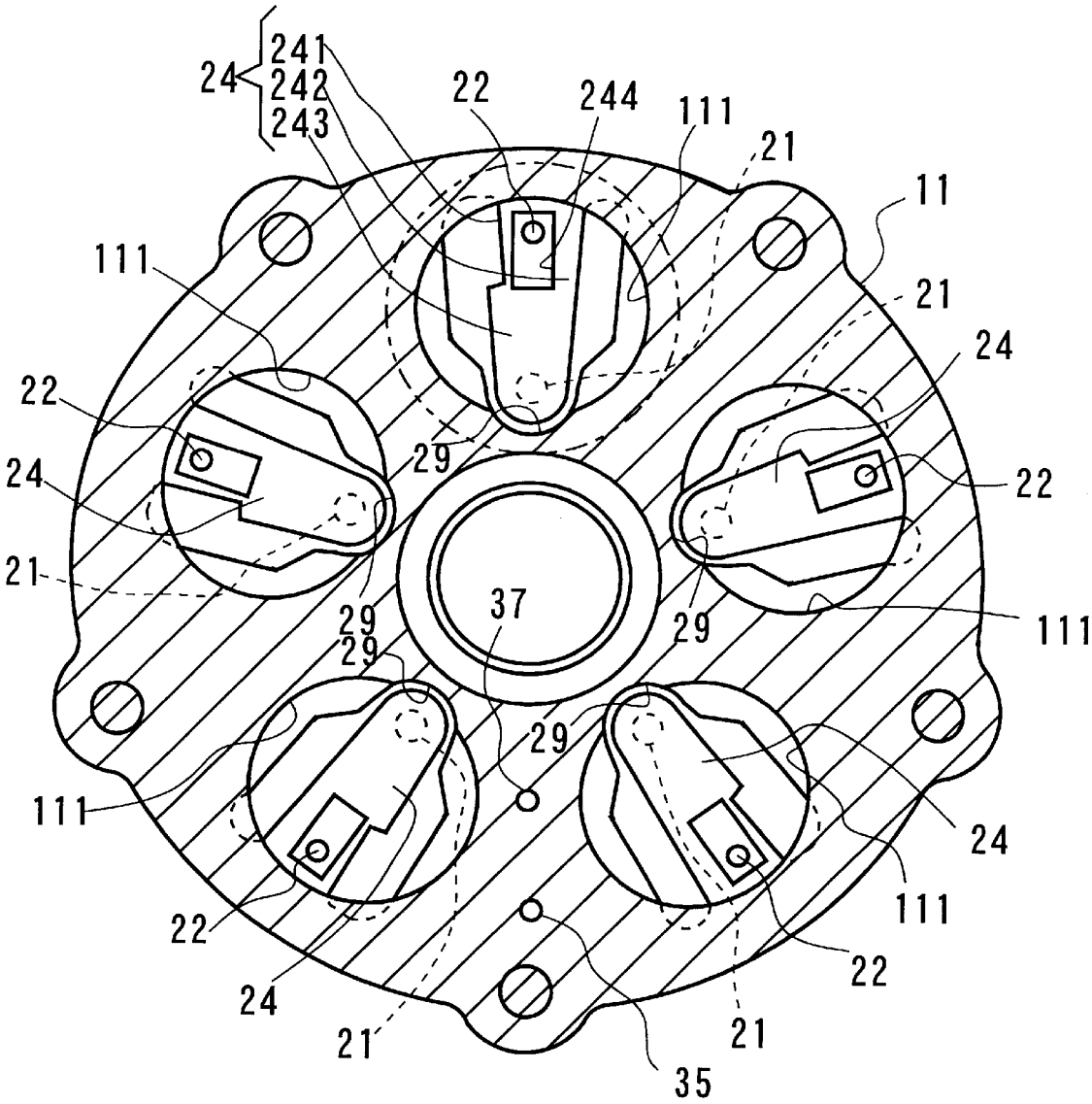
FIG. 2 is an enlarged cross-sectional view as seen from line I—I in FIG. 1.

As shown in FIG. 2, a plurality (five in the embodiment) of the cylinder bores 111 are formed in the cylinder block 11. The cylinder bores 111 are arranged around the axis of the drive shaft 18 at an equal interval and a piston 26 is accommodated in each cylinder bore 111. The rotating movement of the swash plate 20 is converted through shoes 27 to a back-and-forth reciprocating movement of each piston 26, and each piston 26 moves back and forth in the associated cylinder bore 111.

Figure 3:
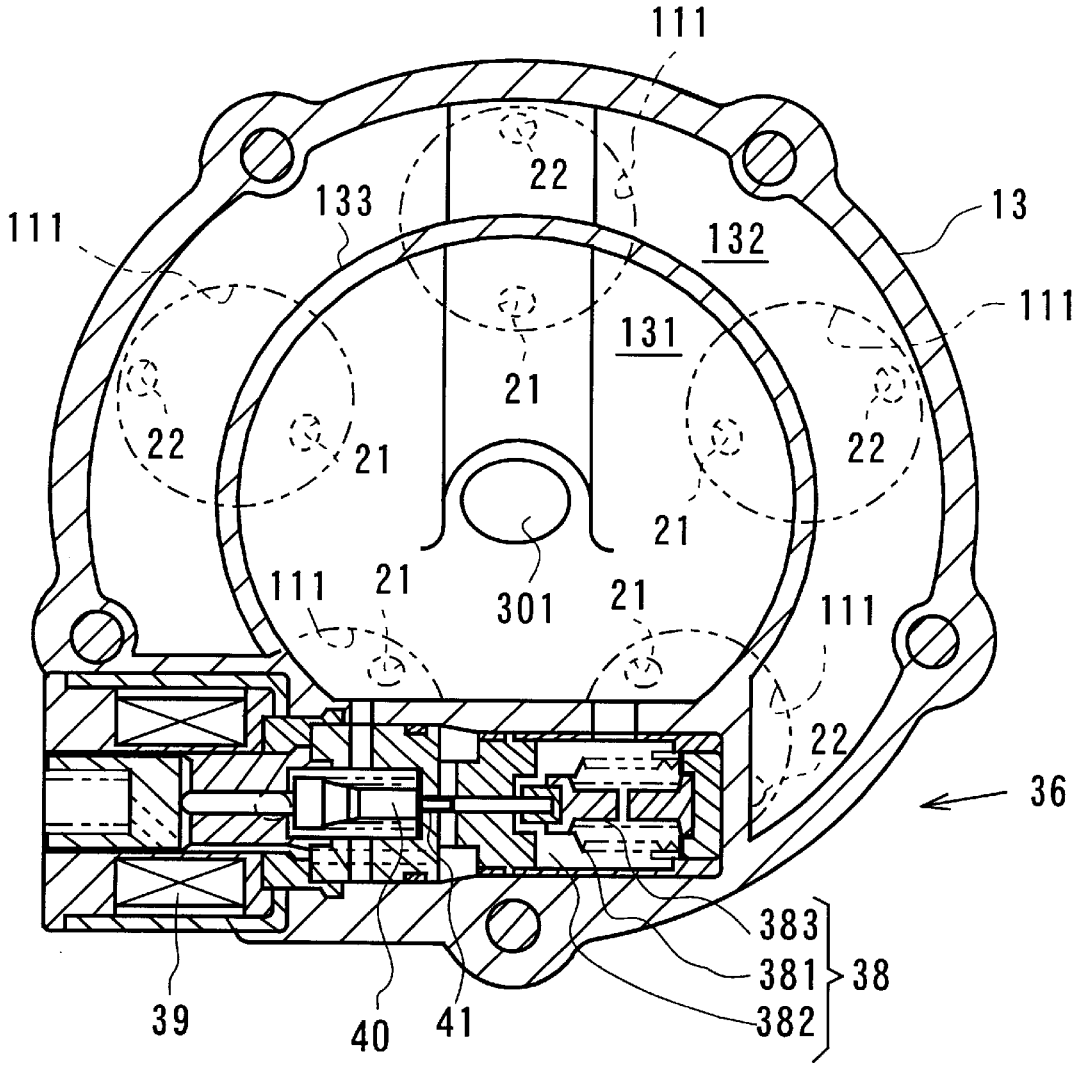
FIG. 3 is an enlarged cross-sectional view as seen from line II—II in FIG. 1.

As shown in FIG. 1 and 3, a suction chamber 131 and a discharge chamber 132 are defined in a rear housing 13. The discharge chamber 132, which is in the region of the discharge pressure, surrounds the suction chamber 131, which is in the region of the suction pressure through the separation wall 133. A supply passage 30 is placed on the back side wall of the rear housing 13. The supply passage 30 extends from a circumferential wall of the rear housing 13 and communicates external refrigerant circuit 31 with the suction chamber 131 across the discharge chamber 132. A suction port 21 corresponding to each cylinder bore 111 is formed in the valve plate 14, the discharge valve disk 16 and the retainer plate 17. A discharge port 22 corresponding to each cylinder bore 111 is formed in the suction valve disk 15 and the valve plate 14. Suction valves 24 are formed on the suction valve disk 15 and discharge valves 161 are formed on the discharge valve disk 16. The suction valves 24 open and close the suction ports 21. The discharge valves 161 open and close the discharge ports 22. Each discharge port 22 communicates with the associated cylinder bore 111 through each opening 244 on each suction valve 24. As shown in FIG. 3, the distances between an outlet 301 of the supply passage 30 and each suction port 21 are nearly equal.

Figure 4:
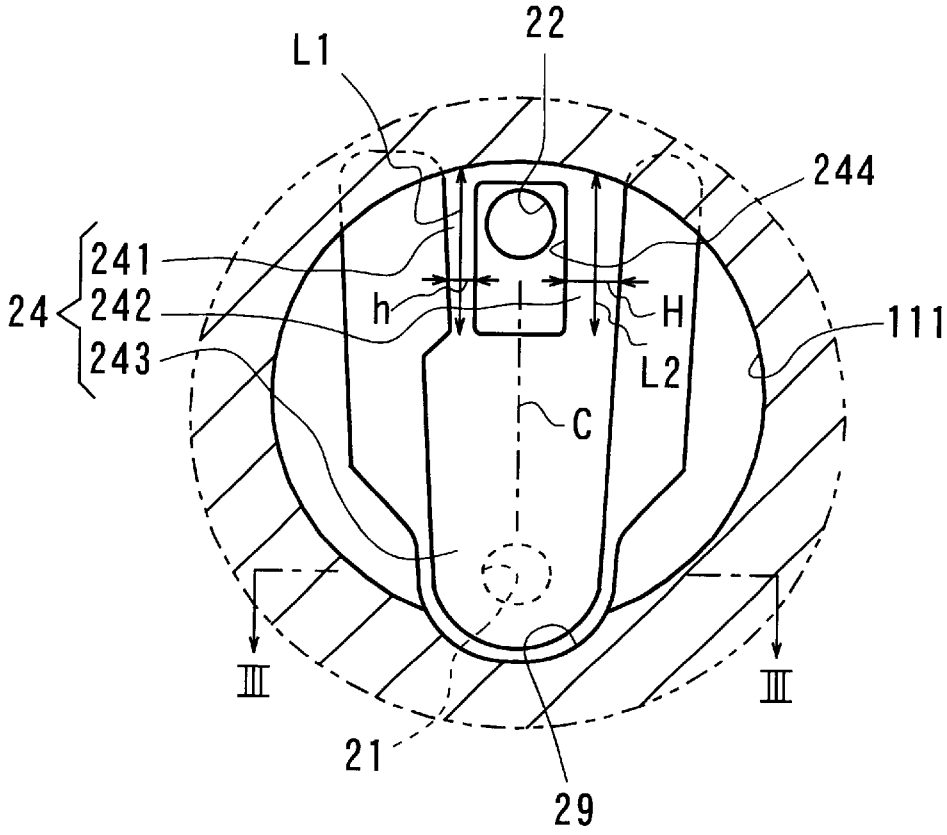
FIG. 4 is an enlarged partial cross-sectional view of FIG. 2.
Figure 4A:
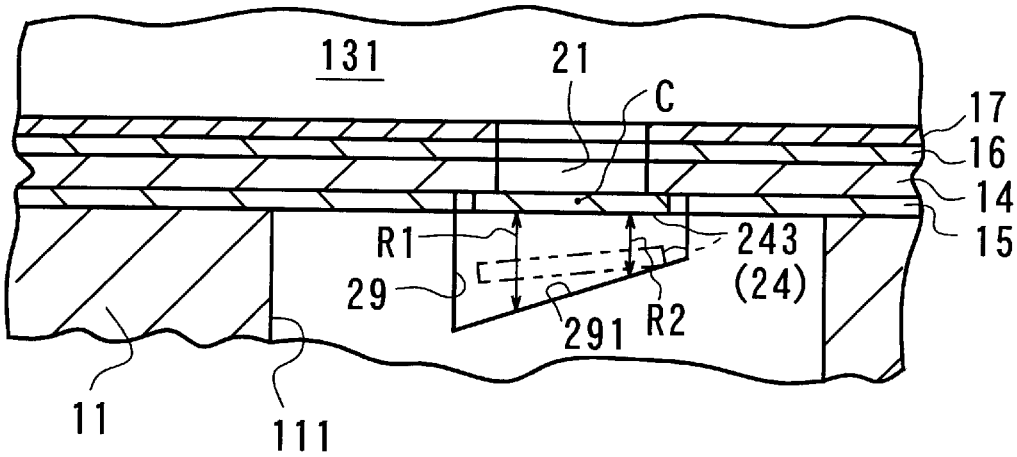

As shown in FIG. 2 and 4, a recess 29 for regulating maximum degree of opening, which is the maximum opening degree regulating means, is formed at each cylinder bore 111. The recess 29 for regulating maximum degree of opening regulates the maximum opening degree of the suction valves 24. As shown in FIG. 4(*a*), a stopper 291, which is the bottom of the recess 29, is inclined in the direction of width of the confronting suction valve 24. The stopper 291 is a receiving portion to receive the suction valve 24 by contacting the suction valve 24. When the suction port 21 is closed by the suction valve 24, the distance between the suction valve 24 and the confronting stopper 291 becomes gradually longer from the right side of the suction valve 24 (on the right side of the central line C in width of the suction valve 24 in FIG. 4 and 4(*a*)) toward the left side of the suction valve 24 (on the left side of the central line C in width of the suction valve 24 in FIG. 4 and 4(*a*)). That is, the recess 29 for regulating maximum opening degree becomes gradually deeper from the right side of the suction valve 24 toward the left side of the suction valve 24.

The refrigerant gas in the cylinder bore 111 is discharged to the discharge chamber 132 through the discharge port 22, pushing up the discharge valve 161 by the discharge action of the piston 26. The opening degree of the discharge valve 161 is regulated by contacting a retainer 171 on the retainer plate 17. The refrigerant gas discharged into the discharge chamber 132 flows outside of the compressor, through a condenser 32, an expansion valve 33 and an evaporator 34 in the external refrigerant circuit 31, and returns to the suction chamber 131 via the supply passage 30.

A magnetic capacity control valve 36 is placed in a pressure supply passage 35 (illustrated in FIG. 2) connecting the discharge chamber 132 with the crank chamber 121. The refrigerant gas in the discharge chamber 132 is supplied to the crank chamber 121 through the pressure supply passage 35. The magnetic capacity control valve 36 is excited and de-excited by the controller (not illustrated), which controls the control valve 36 based on the room temperature detected by the room temperature detector (not illustrated) detecting the room temperature in the vehicle, and on the target room temperature set by the room temperature controller (not illustrated).

The pressure (The suction pressure) in the suction chamber 131 acts through a pressure sensing chamber 382 on a bellows 381 comprising a pressure sensing means 38 in the magnetic capacity control valve 36. The suction pressure in the suction chamber 131 reflects the cooling load. A valve body 40 is connected to the bellows 381, and the valve body 40 opens and closes a valve hole 41. The atmospheric pressure in the bellows 381 and the spring force of a pressure sensing spring 383 comprising the pressure sensing means 38, act on the valve body 40 so as to open the valve hole 41. The magnetic driving force of the solenoid 39 acts to urge the valve body 40 so as to close the valve hole 41. The magnetic capacity control valve 36 controls to set the suction pressure corresponding to the electric current supplied to the solenoid 39.

When the electric current to be supplied increases, the opening degree of the valve hole 41 decreases. So, the amount of the refrigerant gas supplied from the discharge chamber 132 to the crank chamber 121 decreases. The refrigerant gas in the crank chamber 121 flows into the suction chamber 131 through a pressure release passage 37 (as illustrated in FIG. 2), so the pressure in the crank chamber 121 decreases. Accordingly, the inclination angle of the swash plate 20 increases and the discharge capacity also increases. At this time, the increase of the discharge capacity causes the suction pressure decrease. On the other hand, when the electric current to be supplied decreases, the opening degree of the valve hole 41 increases. So, the amount of the refrigerant gas supplied from the discharge chamber 132 to the crank chamber 121 increases. Accordingly, the pressure in the crank chamber 121 increases. The inclination angle of the swash plate 20 decreases and the discharge capacity also decreases. At this time, the decrease of the discharge capacity causes the suction pressure increase.

As shown in FIG. 4, the suction valve 24 is a bendable flexible valve composed of a pair of flexible portions 241 and 242, and of the closing portion 243 placed adjoining to the flexible portions 241 and 242 to form a free end to close the suction port 21. An opening 244 is formed between a pair of flexible portions 241 and 242. While the lengths L1 and L2 of a pair of flexible portions 241 and 242 are nearly equal, the width h of the flexible portion 241 at the left side of the suction valve 24 is shorter than the width H of the flexible portion 242 at the right side of the suction valve 24. The suction valve 24 extends so as to cross the cylinder bore 111 radially from the discharge chamber 132 side to the suction chamber 131 side.

The first embodiment has the following effects.

(1-1) While the lengths L1 and L2 of the flexible portions 241 and 242 of the suction valve 24 are nearly equal, the width h of the flexible portion 241 of the suction valve 24 is shorter than the width H of the flexible portion 242 of the suction valve 24. The thickness of the suction valve 24 integrally formed on the suction valve disk 15 is fixed, so the flexible portion 241 is more liable to bend than the flexible portion 242. That is, the bending flexibility of the flexible portion 241 is higher than that of the flexible portion 242. Accordingly, the suction valve 24 is pushed up from the suction port 21 so as to turn counterclockwise in FIG. 4(*a*). The flexible portions 241 and 242 comprise the bending flexibility regulating means as the twisting flexibility regulating means. When the suction port 21 is closed, the distances between the suction valve 24 and the stopper 291 on the right side and the left side of the central line C are different. As shown in FIG. 4(*a*), the first distance R1 between the suction valve 24 and the stopper 291 on the twisted side of the suction valve 24 (on the left of the central line C in FIG. 4(*a*)) is longer than the second distance R2 between the suction valve 24 and the stopper 291 on the opposite side to the twisted side of the suction valve 24 (on the right of the central line C in FIG. 4(*a*)).

In a small discharge capacity state that a small amount of gas is compressed, as shown in two-dot line in FIG. 4(*a*), the right side of the end portion of the closing portion 243 contacts the stopper 291 of the recess 29 for regulating maximum opening degree. As the right side of the stopper 291 is shallow, the end portion of the closing portion 243 contacts the stopper 291, even in a small discharge capacity state. So, vibrations of the suction valve 24 are prevented, in a state that a small amount of the refrigerant flows.

(1-2) When the bending flexibility of the suction valve 24 is low, the suction valve 24 interferes, as a resistance, the gas flow passing through the suction port 21 during suction movements. That is, the lower the bending flexibility of the suction valve 24 is, the smaller the opening degree of the suction valve 24 becomes. Since the bending flexibility of the flexible portion 241 of the left side of the suction valve 24 is higher than that of the flexible portion 242 of the right side of the suction valve 24, even in a small discharge capacity state that the end portion of the closing portion 243 contacts the stopper 291, the suction valve 24 twists as shown in two-dot line in FIG. 4(*a*). When the bending flexibility of the flexible portion 241 is determined properly highly, the twisting flexibility of the suction valve 24 can increase. That is, the suction valve 24 can be easily twisted. Accordingly, even when the right side of the stopper 291 is shallow so that the right side of the suction valve 24 reaches the stopper 291 soon, the opening degree of the left side of the suction valve 24 increases. As a result, in a small discharge capacity state the resistance at the suction port 21 during suction motion and the power loss are suppressed.

(1-3) When the opening degree of the suction valve 24 further increases after the right side of the end portion of the closing portion 243 contacts the right side of the stopper 291, the suction valve 24 bends, twisting further. Then, the higher flexible portion 241 side of the bending flexibilities of the suction valve 24 approaches the deeper side of the stopper 291. In the arrangement that the bending flexibilities are different each other in the direction of width of the suction valve 24, when the opening degree of the suction valve 24 increases, the suction valve 24 easily twists. And even in a large discharge capacity state, the power loss is suppressed.

(1-4) The bending flexibilities of the flexible portions 241 and 242 can be different when the width h and H of those are unequal. It is a simple structure to make the bending flexibilities of a pair of the flexible portions 241 and 242 different, and the suction valve 24 with this structure twists easily when the opening degree of the suction valve 24 increases.

(1-5) In the arrangement that the discharge chamber 132 is formed around the suction chamber 131, the suction chamber 131 is formed in a cylindrical shape. In the arrangement that the suction chamber is formed around the discharge chamber, the suction chamber is formed in a circular shape. The suction chamber 131 is to suppress the suction pulsation, and the cylindrical suction chamber 131 is superior to the circular suction chamber to suppress the suction pulsation. Moreover, since the distances between an outlet 301 of the supply passage 30 and each suction port 21 are nearly equal, the pressure fluctuation at the outlet 301 is small. The suction pressure fluctuation at the outlet 301 is transmitted through the supply passage 30 to the outer refrigerant circuit 31 as suction pulsations. The evaporator 34 in the passenger room vibrates due to the suction pulsations in the resonance frequency. However, the suction pulsations are small, so the noise caused by the vibrations of the evaporator 34 is small.

(1-6) Each suction valve 24 extends toward the axis of the drive shaft 18 in the radial direction of the drive shaft 18 from the discharge chamber 132 side to the suction chamber 131 side so as to cross the associated cylinder bore 111. So, the flexible portions 241 and 242 have wide ranges of setting in the length considering elastic limit of the material of the suction valve 24, and the suction valve 24 has a wide range of setting in the maximum opening degree. The maximum opening degree of the suction valve 24 influences on the suction pressure loss. When the suction pressure loss decreases, the volumetric efficiency of the refrigerant gas becomes higher. When the suction valve 24 has a wide range of setting in the maximum opening degree, the maximum opening degree of the suction valve 24 of which volumetric efficiency is considered is set easily.

(1-7) The magnetic capacity control valve 36 controls to set the suction pressure (that is, the set suction pressure) in accordance with the electric current supplied to the solenoid 39. When the set value of the suction pressure is increased, the discharge capacity is reduced. When the set value of the suction pressure is increased, the temperature of the refrigerant gas supplied from the evaporator 34 to the compressor becomes high. Especially, when the set suction pressure indicates a superheat 100% state, where the refrigerant from the evaporator 34 is completely evaporated, the inside of the passage from the evaporator 34 to the compressor is in dry condition, and the suction pulsations are easily transmitted. The variable displacement compressor, which varies its discharge capacity between a small capacity and a large capacity, is suitable for an object of the present invention, which can suppress the generation of the pulsations due to the vibrations in a small discharge capacity state, in which the suction pulsations are easily transmitted.

Figure 5:
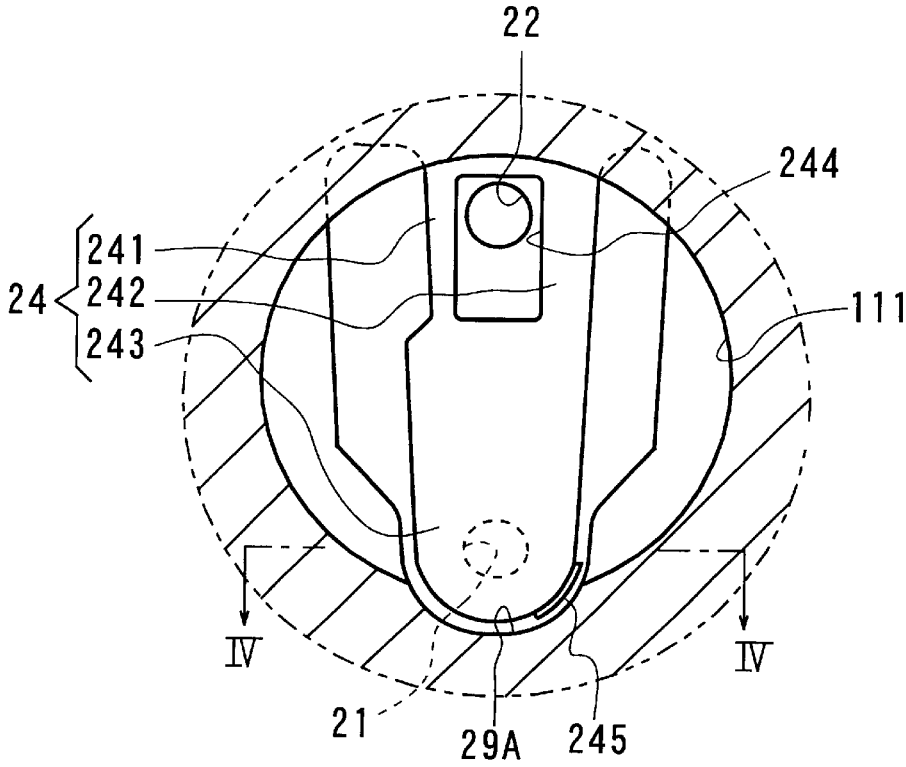
FIG. 5 is an enlarged partial cross-sectional view according to a second embodiment.
Figure 5A:
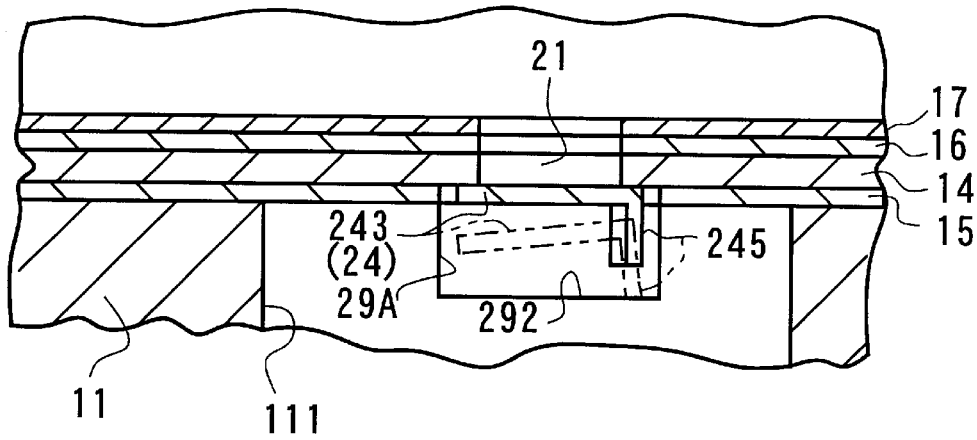

Next, the second embodiment is described in FIG. 5 and FIG. 5(*a*). The compressor is the same variable displacement compressor as the first embodiment, and the same reference numerals as the first embodiment are given to the components corresponding to the first embodiment.

On the end portion of the suction valve 24, a projection 245 for regulating opening degree is integrally formed. The projection 245 is bent at nearly a right angle with respect to the suction valve 24 so as to face the stopper 292 of the recess 29A for regulating maximum opening degree. The stopper 292 of the recess 29A is parallel to the suction valve disk 15. In a small discharge capacity state, the suction valve 24 twists as shown in two-dot line in FIG. 5(*a*), and the projection 245 contacts the stopper 292. As the capacity increases, the suction valve 24 twists further, and the left side of the suction valve 24 approaches the stopper 292. The recess 29A and the projection 245 comprise the maximum opening degree regulating means.

The same effect as the first embodiment can be obtained in the embodiment as well.

Figure 6:
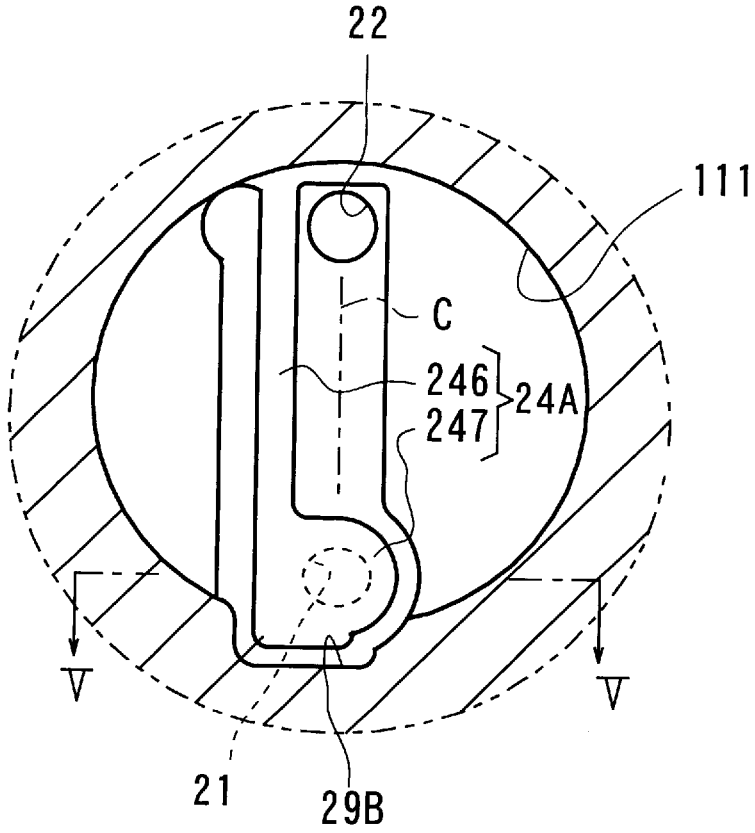
FIG. 6 is an enlarged partial cross-sectional view according to a third embodiment.
Figure 6A:
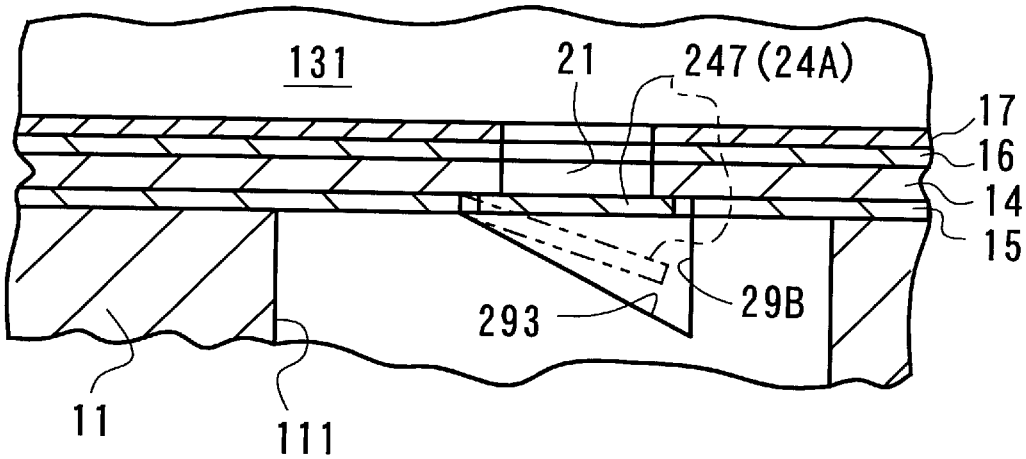

Next, the third embodiment is described in FIG. 6 and FIG. 6(*a*). The compressor is the same variable displacement compressor as the first embodiment, and the same reference numerals as the first embodiment are given to the components corresponding to the first embodiment.

In the embodiment, the suction valve 24A is a bendable flexible valve composed of a single flexible portion 246, and of the closing portion 247 placed adjoining to the flexible portion 246 to form a free end. The flexible portion 246 is biased to the left side from the central line C of the suction valve 24A in FIG. 6. As shown in FIG. 6(*a*), the stopper 293 of the recess 29B for regulating maximum opening degree inclines so that it gradually becomes deeper as it goes from the left side to the right side of the suction valve 24A. The left side of the end portion of the closing portion 247 is almost in contact with the stopper 293 when the suction port 21 is closed by the suction valve 24A as well. And the suction valve 24A twists at the left side of the end portion of the closing portion 247 contacting the stopper 293 from the beginning of the bending. The suction valve 24A which is shown in two-dot line in FIG. 6(*a*) illustrates a twisted condition in a small discharge capacity state.

In the embodiment, even when the suction port 21 is closed by the suction valve 24A, the end of the suction valve 24A is substantially in contact with the stopper 293. So, the vibrations of the suction valve 24A are securely prevented.

In the present invention, the following embodiments can be performed.

(1) The thickness of the flexible portion of the suction valve is applied as the bending flexibility regulating means. In this case, the thinner the flexible portion is, the higher the bending flexibility becomes.

(2) The length of the flexible portion of the suction valve is applied as the bending flexibility regulating means. In this case, the longer the flexible portion is, the higher the bending flexibility becomes.

(3) The bending flexibility is set by adjusting at least two parameters of the width, the length and the thickness of the flexible portion of the suction valve.

As above described in the present invention, the following excellent effect can be performed. A first distance (between a point at the more twisted side on the suction valve in closed position and its confronting point on the receiving portion) is different from a second distance (between a point at the other side on the suction valve in closed position and its confronting point on the receiving portion). And the first distance is longer than the second distance. So, the unusual noise caused by the vibrations of the suction valve in the variable displacement compressor is effectively prevented.

Therefore the present examples and embodiments are to be considered as illustrative and not restrictive and the invention is not to be limited to the details given herein but may be modified within the scope of the appended claims.

What is claimed is:

1. A suction valve in a variable displacement compressor having;

a swash plate accommodated in a crank chamber, where the pressure is controlled, so as to be rotated integrally and inclinably with a drive shaft, and a plurality of pistons accommodated in cylinder bores arranged around the drive shaft and reciprocating in accordance with rotation of said swash plate, wherein the amount of gas supplied from a discharge chamber to the crank chamber and the amount of gas relieved from the crank chamber to the suction chamber is adjusted, whereby the inclination angle of said swash plate is controlled, wherein flexible suction valves open and close suction ports, and in suction movements of pistons said suction valves on said suction ports are pushed up and said gas is drawn into said cylinder bores, said suction valve in said compressor comprising:

a twisting flexibility regulating means regulating said suction valve to bend and twist, and a maximum opening degree regulating means having a receiving portion receiving said suction valve by contacting with said suction valve and regulating maximum opening degree of said suction valve, wherein said maximum opening degree regulating means is formed at said associated cylinder bore, wherein a first distance between said suction valve at the more twisted side in closed position and its confronting point on said receiving portion is longer than a second distance between said suction valve at the other side in closed position and its confronting point on said receiving portion.

2. A suction valve in a variable displacement compressor according to claim 1, wherein said maximum opening degree regulating means is a recess recessed in the direction of the reciprocating movement of said piston, along the circumferential surface of said cylinder bore, and wherein said receiving portion is a bottom of said recess, and wherein said receiving portion is inclined in the direction of width of said confronting suction valve.

3. A suction valve in a variable displacement compressor according to claim 1, wherein said twisting flexibility regulating means comprises bending flexibility regulating means of which bending flexibilities are different each other and arranged in the direction of width of said suction valve, and wherein said distance between the higher bending flexibility side of said suction valve and said confronting receiving portion is longer than that between the lower bending flexibility side and said confronting receiving portion.

4. A suction valve in a variable displacement compressor according to claim 3, said suction valve has a pair of flexible portions separated in width, and a closing portion placed adjoining to the pair of said flexible portions to close said suction port, wherein said bending flexibility regulating means is a pair of said flexible portions, and wherein said each flexible portion urges said suction valve so as to close said suction port, and wherein the bending flexibilities of a pair of said flexible portions are different each other.

5. A suction valve in a variable displacement compressor according to claim 4, wherein the thickness of a pair of said flexible portions are equal, and wherein the bending flexibilities of a pair of said flexible portions are different in accordance with the difference between the widths of a pair of said flexible portions.

6. A suction valve in a variable displacement compressor according to claim 1, wherein said suction valve has a single flexible portion and the closing portion placed adjoining to said flexible portion to close said suction port, and wherein said flexible portion urges said suction valve so as to close said suction port, and wherein said twisting flexibility regulating means is said flexible portion biased from the central line of said suction valve in the direction of width.

7. A suction valve in a variable displacement compressor according to claim 3, wherein a part of said closing portion is substantially constantly in contact with the receiving portion of said recess for regulating maximum opening degree.

8. A suction valve in a variable displacement compressor according to claim 1, wherein a plurality of said pistons are arranged around the drive shaft, and wherein said plurality of pistons reciprocate in said cylinder bores in accordance with the rotation of said drive shaft, and wherein said suction ports are formed in the valve plate defining said suction chamber, said discharge chamber and said cylinder bores, and wherein said discharge chamber is formed so as to surround said suction chamber, and wherein the gas in said suction chamber is sucked through said suction ports into said cylinder bores, and wherein the gas in said cylinder bores is discharged through the discharge ports formed in said valve plate into said discharge chamber.

* * * * *